United States Patent [19]

Favre

[11] 3,947,918

[45] Apr. 6, 1976

[54] DOOR CLOSER

[76] Inventor: Lucien Henri Favre, Gland, Switzerland

[22] Filed: Feb. 25, 1975

[21] Appl. No.: 552,864

[52] U.S. Cl. ..... 16/72

[51] Int. Cl.[2] ..... E05F 1/08

[58] Field of Search ..... 16/49, 50, 52, 53, 71, 16/72, 76, 82, 85, 78–80, 145, 139, 140, 180, 142, 190, 191, 141, 146, 147, 148

[56] References Cited

UNITED STATES PATENTS

| | | | |
|---|---|---|---|
| 753,998 | 3/1904 | Moore | 16/72 |
| 2,513,751 | 7/1950 | Semar | 16/85 |
| 3,608,129 | 9/1971 | Heyer et al. | 16/72 X |
| 3,763,519 | 10/1973 | Favre | 16/72 |

*Primary Examiner*—Geo. V. Larkin
*Attorney, Agent, or Firm*—Bacon & Thomas

[57] ABSTRACT

A door closer includes a cam mounted on a door frame which has a straight portion, a curved portion providing increased compression on a spring biased cam follower and a notch for holding the door in an open position. The cam includes longitudinal serrations and a pair of transverse openings so that the cam can be adjusted inwardly and outwardly relative to the door and the follower. The follower is mounted to the door, as is the cam to the door frame, in such a manner that no mounting screws are visible. Each is provided with mounting plates and the mounting plates are in turn provided with cover plates. The housing which is secured to the housing mounting plate includes means to adjustably modify the bias on the cam follower.

11 Claims, 8 Drawing Figures

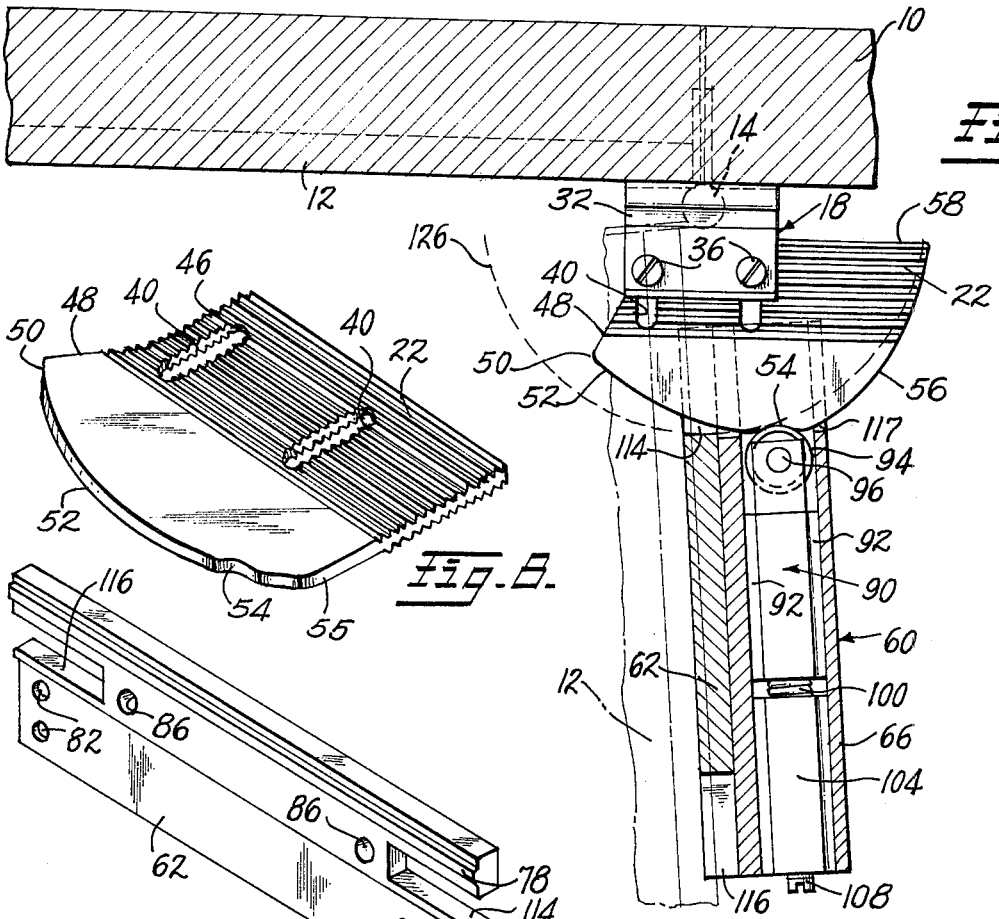
Fig. 5.
Fig. 8.
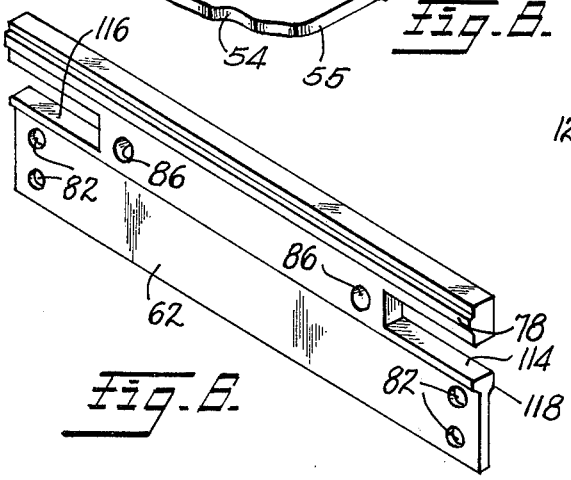
Fig. 6.
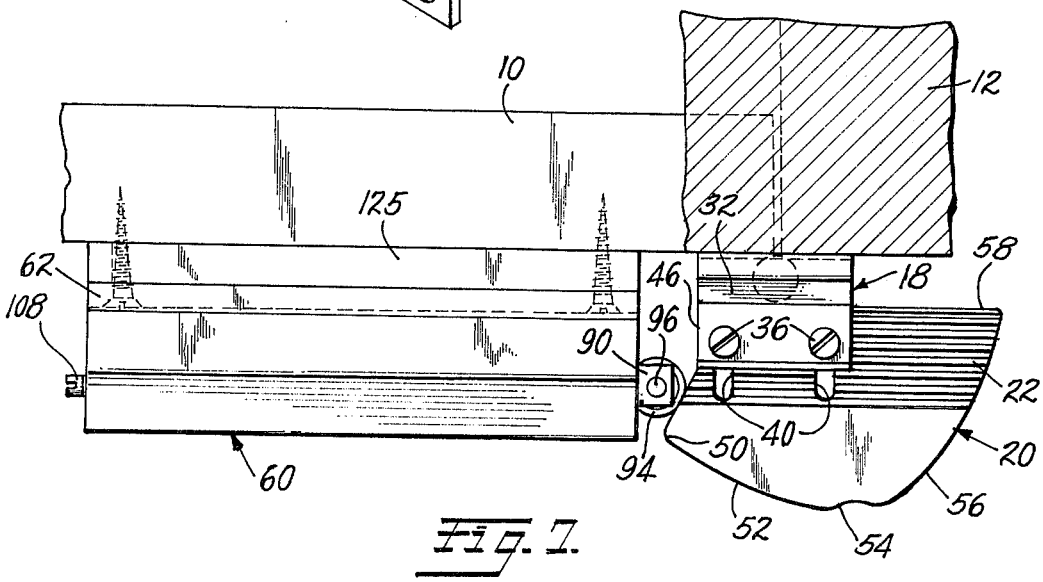
Fig. 7.

DOOR CLOSER

BACKGROUND OF THE INVENTION

The present invention relates to spring biased door closers and is an improvement over my prior U.S. Pat. No. 3,763,519.

Most prior art door closers have various lever, pneumatic brake, and/or cam mechanisms which have imprecise and complicated setting mechanisms. Further, they either occupy a great deal of space and are aesthetically not pleasing to the eye or they must be mounted in the door and/or door frame, thus making them extremely expensive and even more difficult to properly adjust.

SUMMARY OF THE INVENTION

It is an object of the instant invention to provide a reliable, inexpensive door closer which is pleasing to the eye.

The door closer includes a cam mounted on a door frame which has a straight portion, a curved portion providing increased compression on a spring biased cam follower and a notch for holding the door in an open position. The cam includes longitudinal serrations and a pair of transverse openings so that the cam can be adjusted inwardly and outwardly relative to the door and the follower. The follower is mounted to the door, as is the cam to the door frame, in such a manner that no mounting screws are visible. Each is provided with mounting plates and the mounting plates are in turn provided with cover plates. The housing which is secured to the housing mounting plate includes means to adjustably modify the bias on the cam follower.

BRIEF DESCRIPTION OF THE DRAWINGS

FIG. 5 is a plan view similar to FIG. 2 in partial cross-section showing the device when the door is in the open position;

FIG. 6 is a perspective view of the mounting plate;

FIG. 7 is a plan view similar to FIG. 2 of the device wherein a spacer plate is shown for use with flush mounted doors; and FIG. 8 is a perspective view of an alternative embodiment of the cam shown in FIGS. 2, 5 and 7.

DETAILED DESCRIPTION OF THE DRAWINGS

Figure 1:
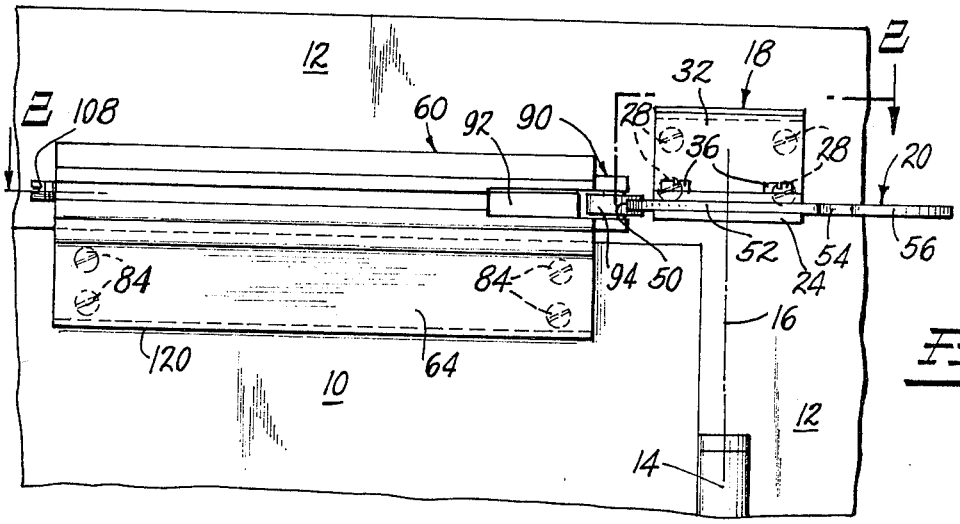
FIG. 1 is a vertical elevational view of a door closer according to the instant invention mounted on a door and door frame.

As seen in FIG. 1 a door 10 is positioned in a door frame 12 and pivoted on one of a plurality of hinges 14. Along an axis 16 of the hinge is mounted a cam holder and mounting means seen generally at 18, the cam holder adjustably supporting a disc shaped cam 20 in a manner discussed in greater detail below. The centerline of the cam holder 18 is mounted along the axis 16 of the hinge 14.

The cam 20 consists of a plurality of longitudinal grooves and ridges in the form of serrations 22 corresponding with serrations in the mounting device 18.

Figure 3:
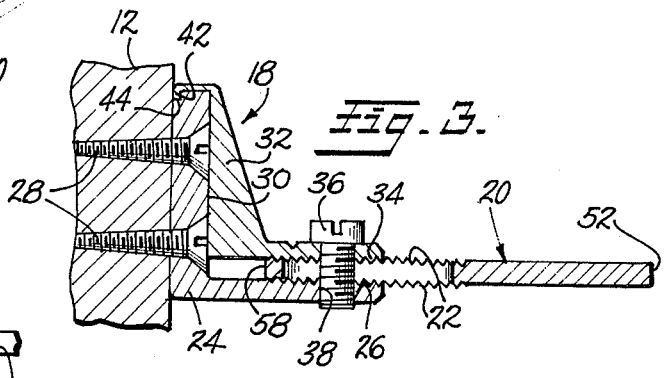
FIG. 3 is a cross-sectional view of the cam portion of the door closer taken along line 3—3 of FIG. 2.

The serrations in the mounting device 18 are best seen in cross-section in FIG. 3 wherein an L-shaped cam mounting member 24 having serrations 26 is mounted to the frame 12 by a plurality of countersunk screws 28. The screws 28 are flush with the surface 30. A cam mounting cover member 32 is also generally L-shaped and has a plurality of serrations 34 cooperating with the serrations 22 on the cam 20 whereby the cam 20 can be adjustably and rigidly secured between members 32 and 24 by means of a pair of screws 36 which are threaded into a pair of corresponding openings 38. The cam 20 has a pair of transverse openings 40 as seen in FIG. 5 whereby the pairs of screws 36 can, in cooperation with members 24 and 32, adjustably position the cam inwardly and outwardly of the frame 12 for the purposes discussed below. The cover member 32 has a hook-shaped portion 42 cooperating with a recess 44 in mounting member 24 for accurately aligning and assisting in positively securing members 24 and 32 together. The cam element 20 is preferably constructed of lightweight aluminum profiles, as are the other elements discussed below. The cam includes a surface 46 flush with the edge of mounting element 18 and at a right angle to the door frame 12. A straight portion 48 angles outwardly toward an edge point 50 which begins a curved portion 52 curving away from portion 48 and terminating in a shallow notch 54. The cam may be cut off along a line 55 at right angles to the door at a point just past the edge of the notch 54 as seen in FIG. 8, or it can continue to curve around along an edge 56 until it reaches a back edge surface 58.

Figure 4:
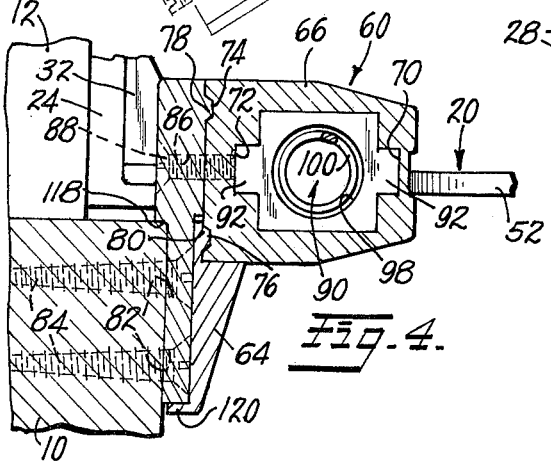
FIG. 4 is a cross-sectional view taken along line 4—4 of FIG. 2 illustrating the cross-section of the spring-biasing, cam follower.

A spring-biased cam follower 60 is secured to the door 10 via a mounting plate 62 (seen in perspective in FIG. 6) and a cover plate 64. The follower member includes a housing 66 and a longitudinal bore 68 extending through its entire length. The cross-section of the housing 66 is seen in FIG. 4 wherein the bore 68 is essentially cross-shaped having a pair of interior recesses 70 and 72. Externally, the housing has a pair of grooves 74 and 76 to receive a pair of rails 78 on mounting plates 62 and 80 on the cover plate 64, respectively.

The mounting plate 62, in addition to rail 78 has a plurality of wall mounting holes 82 to receive a plurality of screws 84 and a pair of holes 86 to receive a pair of screws 88 for mounting the housing 60 through threaded openings 89 therein.

It will be noted from FIGS. 1 and 4 that the cover plate 64 covers the screws 84 to provide a device which is aesthetically more attractive since no screws are visible. The same will be appreciated from the view of FIG. 6 wherein element 32 covers the screws 28.

The housing bore 68 has a roller supporting housing 90 slidably positioned therein. The roller housing 90 has a pair of rail elements 92 which slide in recesses 70 and 72 in the opening 68. Pivotally secured to one end of the housing 90 is a roller cam follower 94 pivoted on rivet or axle member 96. The element 90 further has an axial bore 98 therein to receive one end of a spring 100. The other end of spring 100 is received in a bore 102 of an adjustable stop housing 104. Positioned between the spring 100 and the end of bore 102 is a disc 106 which is adjustably movable within the bore 102 by a threaded adjusting screw 108. The housing 104 is secured in position via a screw 110 inserted through an opening in housing 68 and threadably inserted in an opening 112 in a rail of housing 104. The screw 110 will rigidly secure element 104 relative to the housing 64 so that the adjustment of the spring tension can be varied. The spring obviously provides the pressure of the cam follower 94 against the cam 20.

Figure 2:
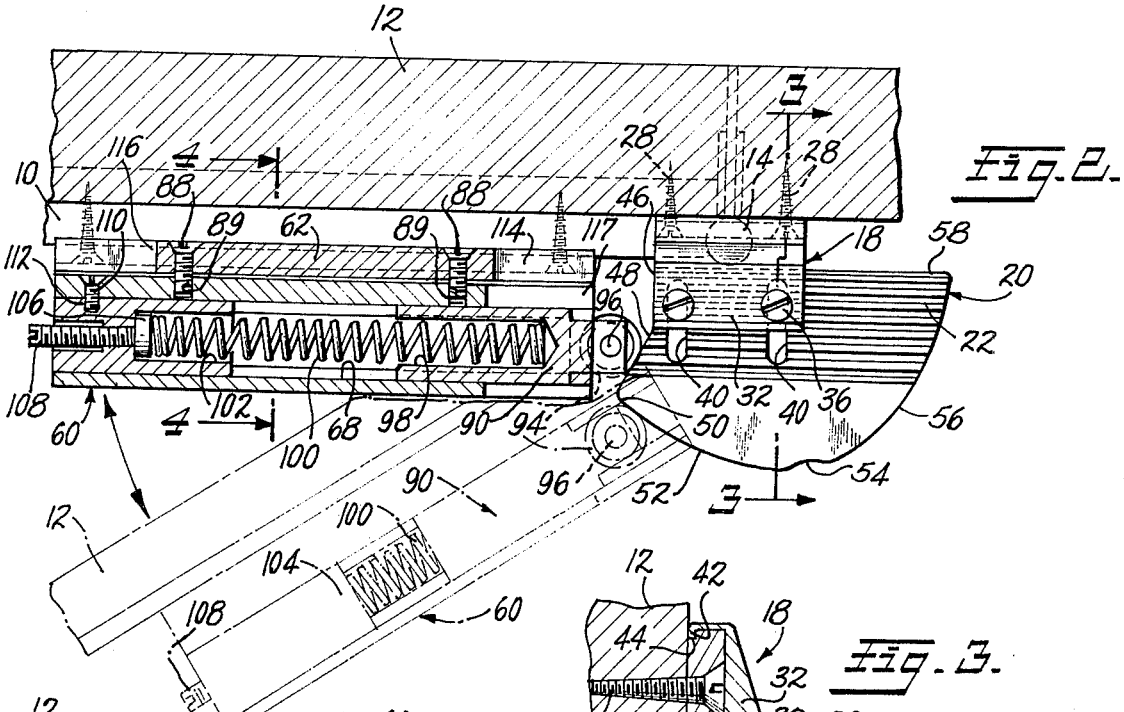
FIG. 2 is a cross-sectional view of the door closer of FIG. 1 taken along line 2—2.

A slot 114 in mounting plate 62 permits the follower housing assembly to pivot around the cam as seen in FIGS. 2 and 5. A similar slot 116 at the end opposite slot 114 permits the insertion and removal of set screw 110 after the unit is mounted on the door whereby it is unnecessary to remove the entire structure from the door if the spring 100 need be removed. A complementary area 117 is seen on the housing 66 in FIGS. 2 and 5 adjacent area 114 to receive the cam when it reaches the position shown in FIG. 5.

In order to properly position the unit relative to the door, a ledge or flange 118 is located on the rear side of element 62. The cover plate 64 has a lower flange 120 cooperating with the mounting plate 62 to further position the members and provide an aesthetically pleasing unit.

If the door and frame are flush, then it is desirable for a liner plate 125 seen in FIG. 7 to be inserted between the mounting member 62 and the door 10. The purpose is to move the cam follower roller 94 to the same position relative to cam 20 as seen in FIG. 2. If the door were flush and the liner plate was not inserted, the roller 94 may be moved inward too great a distance.

Once the unit is mounted as described above, the tension on the spring 100 as exerted by the cam surface 48 on the roller 94 is at a relative minimum. As the door is opened and roller 94 moves along segment 48 past point 50 the compression on the spring is increased. The compression on the spring slightly increases further as the door is swung along curved portion 52 until the roller reaches the shallow notch 54. At this point, the door is maintained in the open position as seen in FIG. 5. Care must be taken that the notch is not too deep so that it takes too much force to move the door toward the closed position. As the door is moved slightly toward the closed position, the force exerted by the cam on the spring and, in turn, onto the door causes the door to move slowly to the closed position.

Due to the shape of the cam, the greatest force on the spring is located on the curved portion 52 nearest the notch 54. Thus, as seen by the arc 126 scribed in FIG. 5, the spring is compressed to its maximum. Therefore, as the door is started to be closed, the compression on the spring is greatest at or near the open position. The compression on the spring slowly decreases (as does the acceleration) until it is at least in the straight line area 48. In this manner there will not be such a tremendous slamming force on the door as it reaches the frame. The serrations 20, together with the notches 26 and 34 provide a means for increasing or decreasing the pressure on the spring. The pressure decreases or increases proportionally as the cam is moved inwardly or outwardly, respectively. Therefore, depending on door size or environmental conditions, the closing force can be adjusted by screw 108 and/or movement of the cam 20. Also the serrations can be used to properly position the cam relative to the follower, depending on the corresponding relative position of the door and door frame, including the position of the hinge 14.

As discussed above, the cam 20 can be cut off as seen in FIG. 8 so that the door closer unit can be mounted where there is a small amount of room between the edge of the cam support and a wall perpendicular to the frame 12.

While one embodiment of the invention has been described, it will be understood that it is capable of many further modifications and this application is intended to cover any variations, uses or adaptations of the invention following in general, the principles of the invention and including such departures from the present disclosure as come within knowledge or customary practice in the art to which the invention pertains, and as may be applied to the essential features hereinbefore set forth and fall within the scope of the invention or the limits of the appended claims.

I claim:

1. A door closer for mounting on a door, and door frame comprising:
   a. a disc shaped cam including:
      1. in succession a straight edge portion at an angle to said door frame, a curved edge portion curving away from said straight edge portion, and a notch,
      2. a plurality of longitudinal grooves and ridges on at least one surface thereof extending parallel to said door frame,
      3. at least one opening in said cam extending perpendicularly to said door frame,
   b. means for mounting said cam on a door frame,
   c. a cam follower including:
      1. a housing,
      2. a cam follower spring biased in said housing against said cam surface and means for adjusting the bias on said cam follower,
   d. means for mounting said cam follower on a door.

2. A door closer as defined in claim 1 wherein said grooves and ridges are closely spaced serrations.

3. A door closer as defined in claim 1 wherein means for mounting said cam on the door frame includes:
   a. an L-shaped mounting plate,
   b. an L-shaped cover plate positioned over and secured to said mounting plate,
   c. said cam being transversely adjustably secured between said plates, at least one of said plates having grooves and ridges complementary with and positioned within the ridges and grooves of said cam.

4. A door closer as defined in claim 3 wherein both said plates have grooves and ridges.

5. A door closer as defined in claim 3 wherein said L-shaped mounting plate has openings in the vertical leg thereof to receive screws or the like for mounting to the door frame, and the vertical leg of said L-shaped cover plate is free of openings and covers said mounting plate openings.

6. A door closer as defined in claim 5 including screw means for joining the horizontal legs of said plates together, said screw means extending through said perpendicularly extending opening.

7. A door closer as defined in claim 1 wherein said means for mounting said cam follower to a door includes:
   a. a mounting plate, said mounting plate having openings in one portion thereof to receive mounting screws and openings in another portion thereof receiving screws joining said housing to said mounting plate, and
   b. said housing and said mounting plate including complementary groove and rail means for positioning said housing relative to said mounting plate.

8. A door closer as defined in claim 7 wherein said housing and said mounting plate include slots therein for receiving the surface of the cam therein when said door moves from its closed position to an open position.

9. A door closer as defined in claim 7 further including:

a. a cover plate, b. said housing and cover plate including complementary groove and rail means for positioning said housing relative to said cover plate, and c. said cover plate being free of openings and covering said openings for receiving mounting screws.

10. A door closer as defined in claim 1 wherein said door has a pivoting axis relative to said door frame and the curved portion of said cam adjacent said notch is a greater distance from said axis than the remainder of said curved portion and said straight portion.

11. A door closer as defined in claim 1 wherein said housing includes:

a. an axial bore therethrough, b. said spring biased cam follower being positioned at one end of said bore, c. a stop housing positioned at the other end of said bore, d. a spring positioned between said stop housing and said follower, e. an adjusting screw threaded through an end of said stop housing, and f. a disc positioned between said spring and said adjusting screw.

* * * * *